United States Patent [19]

Lewis

[11] Patent Number: 4,823,761

[45] Date of Patent: Apr. 25, 1989

[54] ADJUSTABLE COMPOUND LEVERAGE BOWSTRING RELEASE

[75] Inventor: Kenneth D. Lewis, Wisconsin Rapids, Wis.

[73] Assignee: Lewis and Lewis Corporation, Nekoosa, Wis.

[21] Appl. No.: 67,699

[22] Filed: Jun. 26, 1987

[51] Int. Cl.[4] ..... F41B 5/00

[52] U.S. Cl. ..... 124/35 A

[58] Field of Search ..... 124/35 R, 35 A, 40, 124/23 R, 24 R, 21, 22, 25; 74/2

[56] References Cited

U.S. PATENT DOCUMENTS

| | | | |
|---|---|---|---|
| 577,641 | 2/1897 | Bruder | 124/25 |
| 3,490,429 | 1/1970 | Benedict | 124/25 X |
| 3,954,095 | 5/1976 | Lewis | 124/35 A |
| 4,009,703 | 3/1977 | Cunningham, Sr. | 124/35 A |
| 4,036,204 | 7/1977 | Scott | 124/35 A |
| 4,170,216 | 10/1979 | Wilson | 124/35 A |
| 4,192,281 | 3/1980 | King | 124/25 |
| 4,232,649 | 11/1980 | Allen et al. | 124/35 A |
| 4,308,851 | 1/1982 | Kaine, Jr. et al. | 124/35 A |
| 4,391,263 | 7/1983 | Dodge | 124/35 A |
| 4,407,260 | 10/1983 | Lyons | 124/35 A |
| 4,424,791 | 1/1984 | Muehleisen | 124/35 A |
| 4,466,418 | 8/1984 | Jones | 124/35 A |
| 4,476,845 | 10/1984 | Rickard | 124/35 A |
| 4,479,480 | 10/1984 | Holt | 124/35 R |
| 4,485,798 | 12/1984 | Hamm | 124/35 A |
| 4,509,497 | 4/1985 | Garvison | 124/35 A |
| 4,539,968 | 9/1985 | Garvison | 124/35 A |
| 4,567,875 | 2/1986 | Fletcher | 124/35 A |
| 4,574,767 | 3/1986 | Gazzara | 124/35 A |

*Primary Examiner*—Randolph A. Reese
*Assistant Examiner*—John A. Ricci
*Attorney, Agent, or Firm*—Lathrop & Clark

[57] ABSTRACT

An adjustable compound leverage bowstring release which may be held in the hand of an archer includes a housing assembly, a latch cam which is pivotally mounted to the housing assembly and a trigger cam which is also pivotally mounted to the assembly. The housing assembly has an outer contour which is shaped to be grasped by the hand and also has a slot for receiving a bowstring. The latch cam has a notch which receives the bowstring when the bowstring is pulled into the housing assembly slot. As the bowstring is pulled back into the slot, the latch cam is pivoted from its open position to a latched position. In its latched position a lever portion of the latch cam moves through a lever pathway. The trigger cam then is pivoted so that a smooth wall on the trigger cam intersects the latch cam lever portion pathway to prevent the latch cam from returning to its open position. When the archer's hand releases the latch cam, the trigger cam is free to pivot out of the pathway of the latch cam lever portion, thereby allowing the latch cam to pivot to its open position where the bowstring is released.

26 Claims, 5 Drawing Sheets

ADJUSTABLE COMPOUND LEVERAGE BOWSTRING RELEASE

BACKGROUND OF THE INVENTION

1. Field of the Invention

This invention relates to the sport of archery and more particularly to devices and accessories which are used to hold and to release the bowstring.

2. Description of the Prior Art

In the usual manual shooting of a bow and arrow, the bowstring and the arrow are pulled back by the ends of the fingers of one hand of the archer, an operation that requires considerable muscular strength in the archer's fingers. The difficulty encountered in holding the bowstring often results in erratic release of the string by the archer, and a resultant loss of accuracy.

Various devices have been developed which allow the archer to pull back the bowstring by pulling on a bowstring release device with the ends of the fingers of the hand. Depending on the device, the release of the bowstring may be accomplished by pulling a trigger which is provided on the device, or by releasing the trigger. U.S. Pat. No. 4,170,216 to Wilson discloses a bowstring release mechanism having a latching cam which holds the bowstring, and a trigger cam which prevents the latching cam from rotating to release the bowstring until the trigger cam is rotated by the archer's moving the trigger cam by pressing the trigger arm. A bowstring trigger release mechanism having a latching cam, actuator cam, and a plunger which is used to press against and rotate the actuator cam to thereby release the latching cam and bowstring is disclosed in the U.S. Pat. No. 4,009,703 to Cunningham, Sr. Both the Wilson and Cunningham, Sr. bowstring release mechanisms allow for only an active release of the bowstring by the archer's pulling a trigger. U.S. Pat. No. 4,232,649 to Allen et al. discloses a bowstring trigger release which also incorporates a double-cam type mechanism requiring active release. However, the entire trigger actuating device must be in total engagement before the bowstring may be held by the device.

A passive bowstring release mechanism which utilizes a single cam having a lever which is restrained by the hand of the archer when the bowstring is held in the latching portion of the cam is disclosed in U.S. Pat. No. 4,424,791 to Muehleisen. Since the Muehleisen device has only a single cam, the entire force of pulling on the bowstring must be provided by the ends of the fingers of the hand. U.S. Pat. No. 4,539,968 to Garvison discloses a bowstring release device with a double-cam mechanism which operates so that the bowstring may be released either passively by the archer releasing the trigger, or actively by the archer pulling the trigger. The Garvison device has a trigger cam and a latch cam which have complimentary detents which engage to hold the latch cam in its bowstring-engaging position. When the Garvison bowstring release device is used in its passive release mode, a spring moves the trigger cam so that the latch cam is snapped from a detent in the trigger cam when the archer releases the trigger cam. When used in its active release mode, the archer moves the trigger cam so that the latch cam is snapped from a detent in the trigger cam.

SUMMARY OF THE INVENTION

The present invention provides an improved, adjustable compound leverage bowstring release which may be held in the hand of an archer. The bowstring release includes a housing assembly having an outer contour to be grasped by the hand and a slot for receiving a bowstring, a latch cam which is pivotally mounted to the housing assembly, and a trigger cam which also is pivotally mounted to the housing assembly. The latch cam includes a lever portion and a latching portion having a wall against which the bowstring pushes when placed in the slot to pivot the latch cam from an open position to a latched position. The latching portion also has a retaining wall which retains the bowstring within the slot when the latch cam is in a latched position. The lever portion pivots through a lever pathway when the latch cam pivots between the open and latched positions.

The trigger cam includes a smooth wall, and a grip portion which can be pressed by the archer's hand to pivot the trigger cam from a release position to at least one locking position where the smooth wall intersects the lever pathway of the latch cam lever portion to prevent the latch cam from pivoting from the latched position to the open position. One locking position is a hand-held locking position in which the latch cam lever portion imposes a torque upon the trigger cam which tends to pivot the trigger cam toward its release position. This torque is counteracted by the archer's hand pressing the grip portion of the trigger cam. When the archer no longer presses the grip portion, the trigger cam is free to pivot so that the latch cam lever portion pivots the smooth wall out of its lever pathway. With the smooth wall out of the way, the latch cam is free to pivot fully to the open position. The torque which the latch cam lever portion imposes on the trigger cam renders the use of springs to bias the trigger cam unnecessary. The trigger cam may have an additional locking position called the lever-held locking position, from which the locking cam is pivoted from to its release position in an active manner by pressing a push release portion of the trigger cam. In such an embodiment, the smooth wall is off-set from a pivotal access of the trigger cam away from the pivotal access of the latch cam. The latch cam lever portion in such a case must be of length such that a tip of the lever portion can pass between the smooth wall and the pivotal axis of the trigger cam when the trigger cam is in its release position, so that the latch cam lever portion can abut against an active portion of the smooth wall to impose a torque on the trigger cam which maintains the trigger cam in the lever-held locking position until the archer imposes a counteracting torque by pressing the push release portion of the trigger cam to pivot the trigger cam toward its release position. Preferably, the compound leverage bowstring release includes means for adjusting the locking position of the trigger cam which restricts how far the trigger cam may rotate away from its release position. The trigger cam may be adjusted so that it is only able to pivot to its hand-held locking position, and not to its lever-held locking position. Alternatively, the adjustable compound leverage bowstring may be constructed so that it is operable in only a passive release manner. In such a case, the latch cam trigger portion tip would press against only a passive portion of the smooth wall on the trigger cam when the trigger cam is in its locking position.

The adjustable compound leverage bowstring release allows an archer to pull back a bowstring by pulling on the housing assembly with the entire hand of the archer, instead of pulling the bowstring with the ends of the fingers. The provision of both a latch cam and trigger cam within the bowstring release allows the bowstring to be held without the entire force of the pulling on the bowstring being transmitted through the cams to the fingers of the archer. Instead, much of the force which resists the pivoting of the latch cam to release the bowstring is provided by the trigger cam with its smooth wall which prevents the pivoting of the latch cam. Furthermore, as the trigger cam moves toward its release position, the latch cam lever portion sweeps across the smooth wall of the trigger cam until the smooth wall is completely out of the lever pathway. As such, the latch cam lever portion does not encounter any notches, detents, or corner portions from which it must be released. The release of the latch cam to its open position is therefore accomplished in a smooth continuous manner without the roughness or jerks that might otherwise occur.

Further objects, features, and advantages of the invention will be apparent from the following detailed description when taken in conjunction with the accompanying drawings.

DESCRIPTION OF THE PREFERRED EMBODIMENTS

Figure 1:
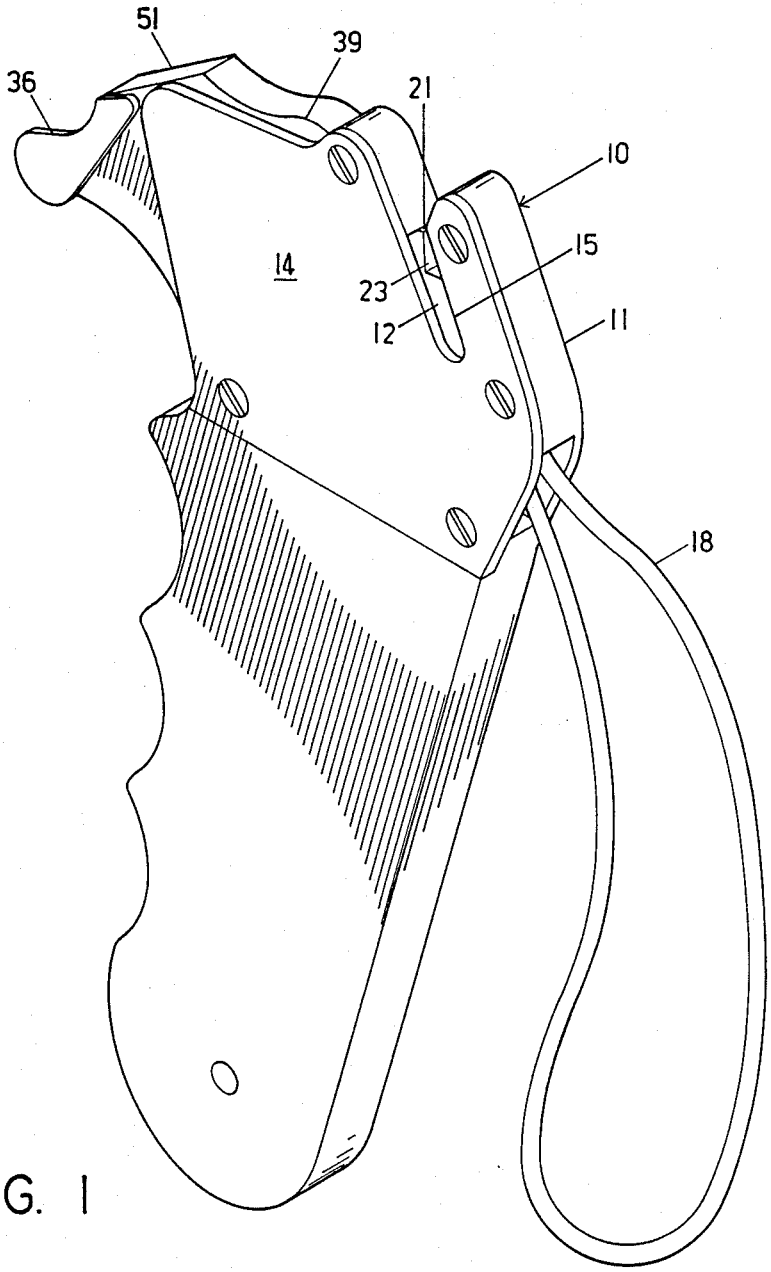
FIG. 1 is a perspective view of an adjustable compound leverage bowstring release in accordance with the present invention.
Figure 2:
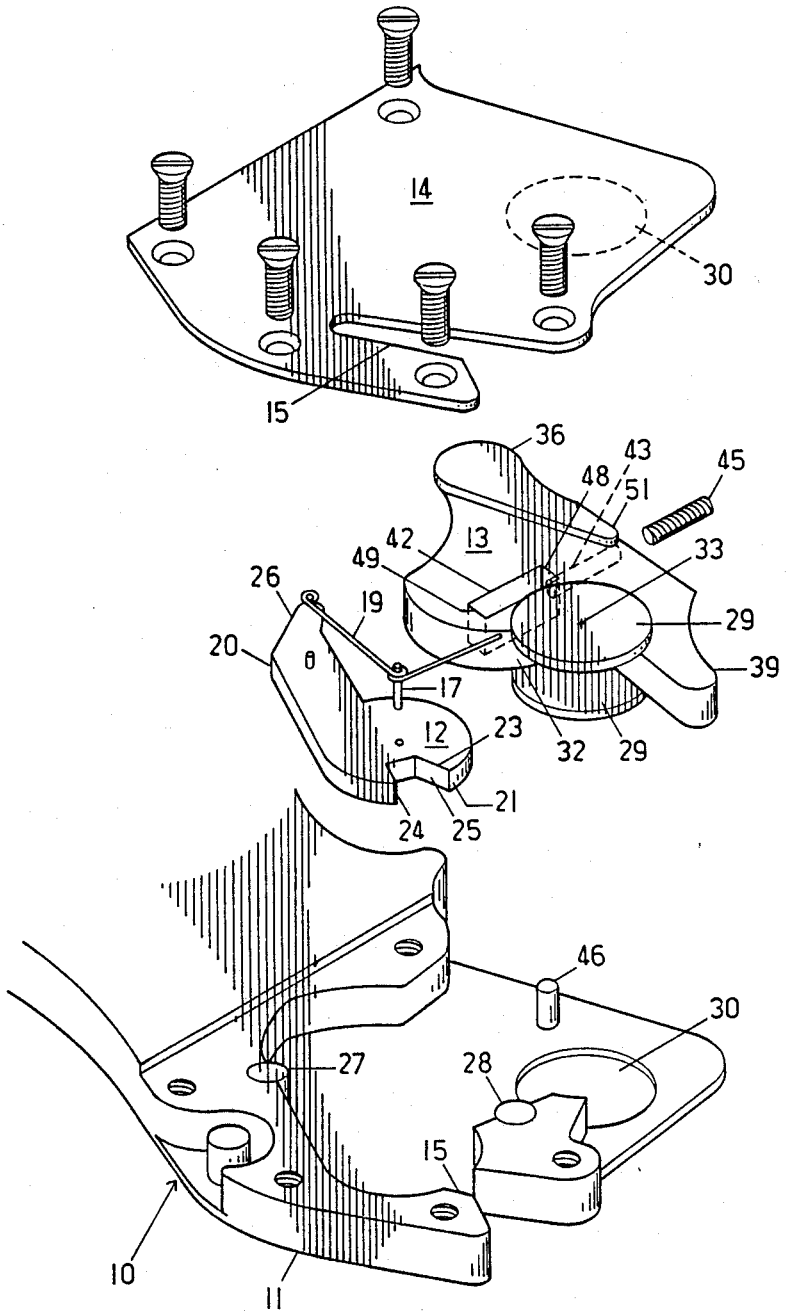
FIG. 2 is an exploded perspective view of the first adjustable compound leverage bowstring release of FIG. 1.
Figure 3:
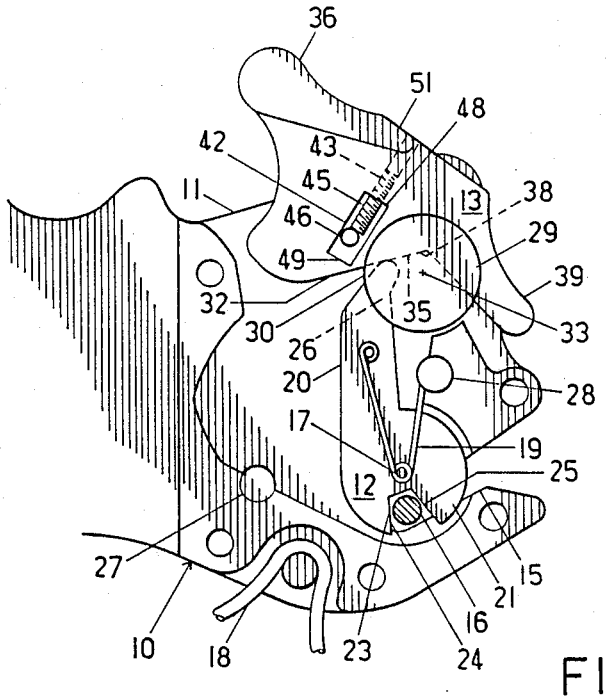
FIG. 3 is a top plan view of a fragmentary portion of the bowstring release of FIG. 1 with the cover plate removed and the bowstring release cocked with the trigger cam in its hand-held locking position.

With reference to the drawings, a first preferred embodiment of an adjustable compound leverage bowstring release is shown generally at 10 in FIG. 1. FIG. 2 shows a fragmentary portion of the bowstring release in an exploded perspective view. The release 10 includes a housing assembly 11, a latch cam 12, and a trigger cam 13 which both are pivotally mounted to the housing assembly 11 as best shown in FIG. 3. The cover plate 14 is removed in FIGS. 3–5, but shown in FIGS. 1–2. The bowstring release 10 may also include a wrist cord 18 which wraps around the archer's wrist.

The housing assembly 11 has an outer contour as shown in FIG. 1 which is formed to be grasped by the hand of an archer. The housing assembly has a slot 15 which is formed for receiving a bowstring 16. The latch cam 12 is pivotally mounted to the housing assembly 11 by means of the pin 17, and may be biased to its open position shown in FIG. 4 by the return spring 19. The latch cam 12 includes a lever portion 20 and a latching portion 21. The latching portion 21 has a notch 23 which forms a drive wall 24 against which the bowstring 16 pushes when placed in a slot 15 to pivot the latch cam 12 from an open position to a latched position, and a retaining wall 25 which retains the bowstring 16 within the slot 15 when the latch cam 12 is in its latched position. The latch cam lever portion 20 with tip 26 is able to pivot between the bumpers 27 and 28 and pivots through a lever pathway when the latch cam 12 pivots between its open and latched positions. The latch cam 12 is shown in its open position in FIG. 4, and in its latched positions in FIGS. 3 and 5. The return spring 19 is really only necessary to bias the latch cam 12 to its open position when a bowstring 16 has not already been received into the notch 23. At that time, the latch cam 12 should be biased to its open position, so that it is able to receive the bowstring 16. Once a bowstring 16 is received in the notch 23 and the latch cam is pivoted to is latched position, the archer's pulling of the bowstring 16 with the bowstring release 10 will cause the latch cam 12 to be biased to its open position. The latch cam 12 is prevented from moving to its open position until permitted to do so by the trigger cam 13.

As shown in FIG. 2, the trigger cam 13 includes two spool portions 29 which project axially outwardly so as to be pivotally registered in corresponding cavities 30 within the housing assembly 11. Thus, the trigger cam 13 pivots as its spool portions 29 pivot within their respective cavities 30 in the housing assembly 11. The trigger cam 13 includes a smooth wall which intersects the lever pathway of the latch cam lever portion when the trigger cam is positioned in one of its locking positions. The pivotal axis of the trigger cam 13 extends through the centers of the spool portions 29 at 33. The spool portions 29 extend forwardly of the smooth wall 32 so that the smooth wall 32 faces toward the trigger cam pivotal axis 33. The smooth wall 32 is therefore offset from the pivotal axis 33 of the trigger cam 13 in a direction away from the pivotal axis of the latch cam 12 formed by the pin 17. The smooth wall 32 is defined to be "smooth" because it is a continuous curvilinear even surface without notches, detents, or corners, or any obstructions or impediments which provide a resistance to sliding over the surface of the smooth wall 32. Therefore, as the tip 26 of the latch cam lever portion 20 slides across the smooth wall 32, from engagement to disengagement the smooth wall 32 provides no substantial resistance to the sliding of the lever portion tip 26.

Figure 4:
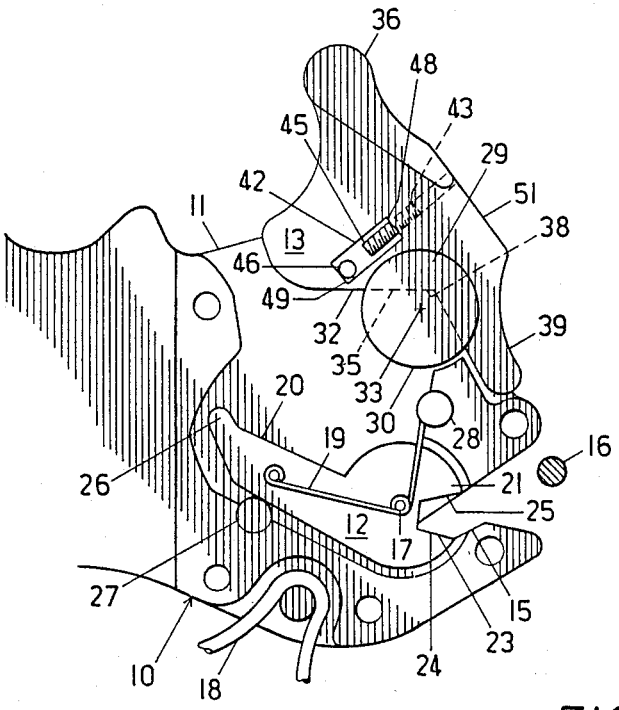
FIG. 4 is a top plan view of a fragmentary portion of the bowstring release of FIG. 1 with the cover plate removed showing the release of the bowstring.

As shown in FIG. 4, the trigger cam 13 of the bowstring release 10 has a release position where the smooth wall 32 no longer intersects the lever pathway of the latch cam lever portion 20. Thus the trigger cam 13 in its release position allows the latch cam 12 to swing freely back and forth between the latch cam's latched position and open position. The trigger cam 13 has two different locking positions where the smooth wall 32 prevents the pivoting of the latch cam lever portion 20 from its latched position to the open position. As shown in FIG. 3, the trigger cam 13 and latch cam lever portion 20 may be pivoted so that the lever portion tip 26 presses against the smooth wall 32 to impose a torque which tends to pivot the trigger cam 13 toward its release position. The portion of the wall 32 which when pressed causes the torque which tends to pivot the trigger cam 13 toward its release position is called the "passive portion" 35 of the smooth wall 32. When the trigger cam 13 is positioned so that the latch cam lever portion tip 26 is able to press against the smooth wall passive portion 35, the trigger cam 13 is said to be in its "hand-held locking position". The trigger cam 13 includes a grip portion 36 which can be pressed by the archer's hand to pivot the trigger cam from its release position to the hand-held locking position. The torque exerted by the archer's hand on the grip portion 36 counteracts the torque applied to the trigger cam 13 by the latch cam lever portion 20, until the archer releases the grip portion 36 to allow the trigger cam 13 to be driven back to its release position. This type of release which is accomplished by the archer's letting go of the trigger cam grip portion 36 is called a "passive" release.

Figure 5:
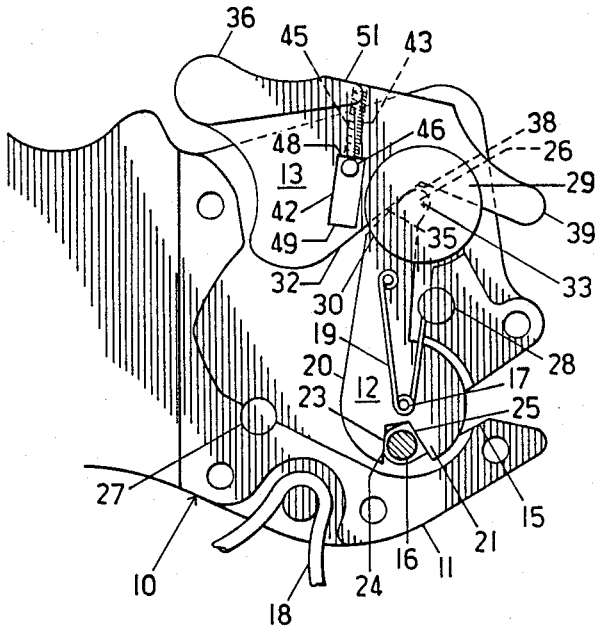
FIG. 5 is a top plan view of a fragmentary portion of the bowstring release of FIG. 1 with the cover plate removed and showing the bowstring release cocked with the trigger cam in its lever-held locking position.

As shown in FIG. 5, the trigger cam 13 and latch cam lever portion 20 both may be positioned so that the lever portion tip 26 presses against a portion of the smooth wall 32 to impose a torque which maintains the trigger cam 13 in its locking position. This portion of the smooth wall 32 when pressed causes a torque which maintains the trigger cam 3 in its locking position is called the "active portion" 38 of the smooth wall 32. The position of the trigger cam 13 where the lever portion tip 26 is able to press against the wall active portion 38 is referred to as the "lever-held locking position". It is noted that in order to reach the wall active portion 38 of this particular embodiment, the latch cam lever portion tip 26 must be able to cross over a line segment which extends perpendicularly from the smooth wall 32 to the trigger cam pivotal axis 33. To the right side of this line segment is the wall active portion 38, and to the left side of the line segment is the wall passive portion 35. As the tip 26 passes through this line segment, it passes "directly between" the pivotal axis 33 and the smooth wall 32. The trigger cam 13 includes a push release portion 39 which when pressed pivots the trigger cam 13 toward its release position. Thus the archer's hand when pushing the release portion 39 exerts a torque which counteracts the torque applied by the latch cam lever portion 20 on the trigger cam 13 at the wall active portion 38. This type of release which is accomplished by the archer's hand pressing on the trigger cam push release portion 39 is called an "active" release.

The bowstring release 10 further includes a means for adjusting the locking position of the trigger cam 13. Preferably, the locking position adjusting means includes interior surfaces of the trigger cam 13 which form an elongated groove 42 and a threaded bore 43, an adjusting screw 45 within the bore 43, and a peg 46 which extends from the housing assembly 11 into the groove 42. The elongated groove 42 has a first end 48 and a second end 49 as shown in FIGS. 2–5. The threaded bore 43 extends longitudinally with respect to the groove 42 from an exterior surface 51 of the trigger cam 13 to the first end 48 of the groove 42. The adjusting screw 45 may be turned within the bore 43 to extend a selected distance into the groove 42. When the trigger cam 13 is in its release position, the trigger cam 13 is prevented from pivoting beyond where the peg 46 abuts against the second end 49 of the groove 42 as shown in FIG. 4. The peg 46 also prevents the trigger cam 13 from pivoting into a locking position beyond where the peg 46 abuts against the adjusting screw 45, or if the adjusting screw 45 is retracted from the groove 42, the groove first end 48. When the adjusting screw 45 is turned to an extended position as shown in FIG. 3, the peg 46 abuts against the screw 45 when the trigger cam 13 is in its hand-held locking position. The trigger cam 13 is thus prevented from being pivoted further into the lever-held locking position shown in FIG. 5. In this manner, the bowstring release 10 is adjusted so as to be operable only in a passive manner. When the adjusting screw 45 is turned to a retracted position as shown in FIG. 5, the trigger cam 13 is fully pivotable to its lever-held locking position. Thus when the adjusting screw 45 is in its retracted position, the adjustable bowstring release 10 may be operated in an active manner. While the adjusting screw 45 is in its retracted position, however, it would be difficult, though possible, to operate the adjustable bowstring release 10 in a passive manner. In order to operate the bowstring release 10 in a passive manner when the screw 45 is in its retracted position, the archer would have to pivot the trigger cam 13 no further than its hand-held locking position. Nothing, however, would prevent the archer from accidentally rotating the trigger cam 13 further into its lever-held locking position. It is to be understood that other embodiments of the invention might adjust the locking position of the trigger cam in another manner. For example, a screw could be placed within a threaded bore within the housing assembly in a position where a turning of the screw would adjust the locking position.

In its operation, the adjustable compound leverage bowstring release 10 of FIGS. 1–5 is intended to be used by archers as an aid in pulling and releasing a bowstring 16. The bowstring release 10 may be used in either an active or passive manner, depending particularly on the position of the adjusting screw 45. If it is intended that the bowstring release 10 be used in a passive manner, it is advisable to turn the adjusting screw 45 until it reaches its extended position as shown in FIG. 3. The bowstring 16 should then be placed into the slot 15, so that the bowstring 16 presses against the drive wall 24 to pivot the latch cam 12 until it reaches its latched position as shown in FIG. 3. While the latch cam 12 is being rotated to its latched position, the trigger cam 13 should be in its release position to allow the latch cam 12 to pivot to its latched position. Once the latch cam is located in its latched position, the archer may press his hand against the grip portion 36 of the trigger cam 13 to pivot the trigger cam 13 to its hand-held locking position where the lever portion tip 26 abuts against the wall passive portion 35 and the peg 46 abuts against the adjusting screw 45. While the archer presses against the grip portion 36, the bowstring 16 is pulled back to its desired position with the aid of the adjustable bowstring release 10. The bowstring 16 is released when the archer releases his/her grip on the grip portion 36 of the trigger cam 13. When the trigger cam 13 is thus released, the torque applied to the trigger cam 13 by the latch cam lever portion 20 rotates the trigger cam 13 toward its released position. As the trigger cam 13 pivots, the lever portion tip 26 moves smoothly and continuously across the smooth wall 32 without any jerking or snapping motion. Since there are no obstacles, notches, detents, or corners on the smooth wall 32 which would impede the progress of the lever portion tip 26, the release of the lever portion 20 is not a snapping motion, but instead is a smooth, gradually accelerating motion. Once the smooth wall 32 is entirely out of the lever pathway of the latch cam lever portion 20, the latch cam 12 is free to pivot to its open position where the bowstring 16 exits the slot 15 as shown in FIG. 4. In the open position the latch cam lever portion 20 rests against the bumper 27.

Thus, through the use of the two leverage cams 12 and 13, the archer is able to lock the bowstring 16 within the first preferred adjustable bowstring release 10 without the tips of the archer's fingers resisting the entire pull force exerted by the bowstring 16 through the grip portion 36. Only a small portion of the pull force is resisted by the archer's fingers pressing on the grip portion 36 when the trigger cam 13 is in its hand-held locking position as shown in FIG. 3. Furthermore, the release of the latch cam 12 occurs as a smooth continuous motion, without any jerking or snapping motion which could cause an erratic release.

As shown in FIG. 5, the bowstring release 10 is also operable in an active manner. To operate in an active manner, the adjusting screw 45 must be turned to its retracted position as shown in FIG. 5 so that the trigger cam 13 may be pivoted fully to its lever-held locked position. Again, the bowstring 16 must be placed into slot 16 so that the bowstring 16 presses against the drive wall 24 to pivot the latch cam 12 to its latched position which is shown in FIG. 5. While the latch cam 12 is being pivoted to its latched position, the trigger cam 13 should be positioned so that the smooth wall 32 does not block the lever pathway of the lever portion 20. Once the lever portion 20 is far enough toward its latched position so that it can begin pressing against the smooth wall 32, the trigger cam 13 can be pivoted by the archer's hand pulling the grip portion 36 so that the smooth wall 32 pushes the lever portion 20 fully back into its latched position as shown in FIG. 5. Once the lever portion tip 26 presses against an active portion 38 of the smooth wall 32, the lever portion 20 exerts a torque on the trigger cam 13 which maintains the trigger cam 13 in this lever-held locking position. Once the trigger cam 13 is in this lever-held locking position, the latch cam 12 can only be released by the archer's hand pressing against the push release portion 39 of the trigger cam 13. It can be seen from FIGS. 4 and 5 that as the trigger cam 13 is pushed by the archer's hand, it rotates toward the release position and the tip 26 of the latch cam lever portion 20 moves smoothly across the smooth wall 32 from the active portion 38 thereof to the passive portion 35 thereof. Once the tip 26 reaches the smooth wall passive portion 35, the archer no longer needs to press the push release portion 39 of the trigger cam 13. The tip 26 moves smoothly from engagement to disengagment across the smooth wall 32 without being impeded by any corners, notches, or detents. The sliding motion of the tip 26 against the smooth wall 32 is therefore smooth and continuous without any jerking or snapping motion which could cause an inaccurate release of the bowstring 16. Once the smooth wall 32 is pivoted totally out from the lever pathway of the latch cam lever portion 20, the latch cam 12 continues to pivot to its open position where the notch 23 is aligned with the slot 15 and the bowstring 16 is released.

Figure 6:
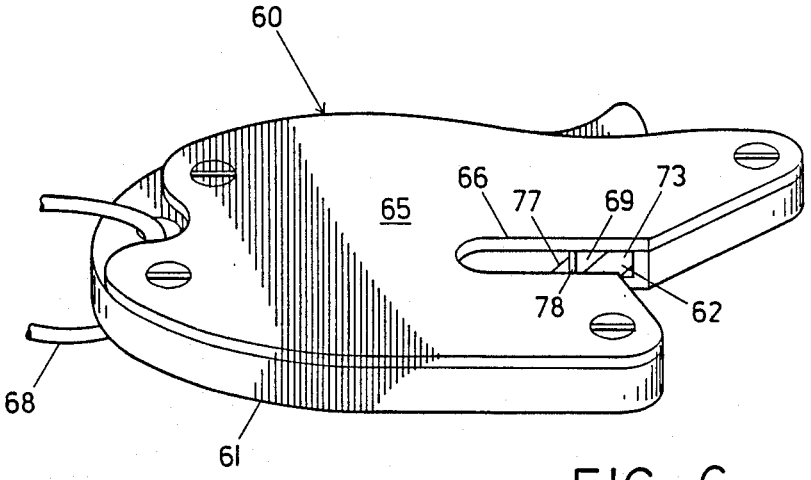
FIG. 6 is a perspective view of another adjustable compound leverage bowstring release in accordance with the present invention.
Figure 7:
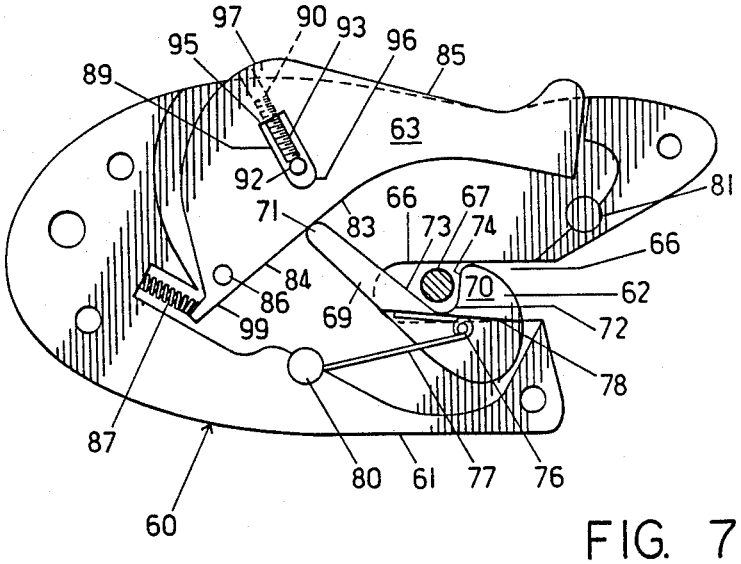
FIG. 7 is a top plan view of a fragmentary portion of the bowstring release device of FIG. 6 with the cover plate removed showing the bowstring release cocked with the latch cam locked against the trigger cam.
Figure 8:
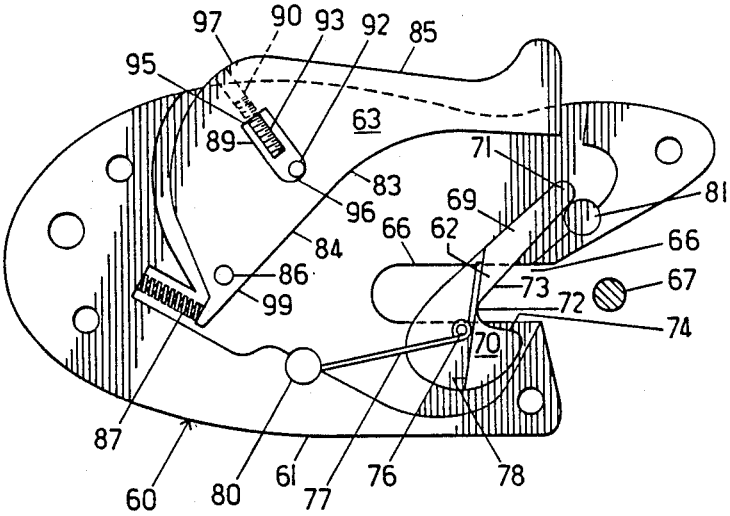
FIG. 8 is a top plan view of a fragmentary portion of the bowstring release of FIG. 6 with the cover plate removed showing the release of the bowstring.

An adjustable compound leverage release which is operable only in a passive manner is shown generally at 60 in FIGS. 6–8. The bowstring release 60 includes a housing assembly 61, a latch cam 62 which is pivotally mounted to the housing assembly 61, and a trigger cam 63 which also is pivotally mounted to the housing assembly 61. The housing assembly 61 has a cover 65, an outer contour to be grasped by the archer's hand, and a slot 66 which is adapted for receiving the bowstring 67. FIGS. 7 and 8 show the bowstring release 60 with the cover plate 65 removed. The bowstring release 60 may also include a wrist cord 68 into which the archer may insert his/her wrist.

The latch cam 62 includes a lever portion 69 with tip 71, and a latching portion 70 with a notch 72 formed therein by a drive wall 73 against which the bowstring 67 pushes when it is placed in he slot 66 to pivot the latch cam 62 from an open position to a latched position and a retaining wall 74 which retains the bowstring 67 within the slot 66 when the latch cam 62 is in its latched position. The latch cam lever portion 69 is free to pivot between the bumpers 80 and 81, and pivots through a lever pathway when the latch cam 62 pivots between its open and latched positions. As shown in FIG. 7 the latch cam 62 preferably is mounted to the housing assembly 61 by means of the pin 76. The latch cam 62 is biased to its open position by the return spring 77 which is braced at the bumper 80 and pushes against the wall 78 on the latch cam 62.

The trigger cam 63 includes a smooth wall 83 with substantially only a passive portion 84 to the wall 83, and a grip portion 85 which may be pressed by an archer's hand to pivot the trigger cam 64 from its release position to a hand-held locking position where the smooth wall passive portion 84 intersects the lever pathway of the latch cam lever portion 69 to prevent the latch cam 62 from pivoting from its latched position to its open position. The trigger cam 63 is pivotally mounted to the housing assembly with the pin 86. When the latch cam 62 is pivoted to its latched position, the latch cam lever portion 69 can abut and press against the passive portion 84 of the smooth wall 83 to impose a torque upon the trigger cam 63 which tends to pivot the trigger cam 63 toward its release position. This torque is counteracted by the archer's hand pressing the trigger cam grip portion 85 to keep the trigger cam 63 in its hand-held locking position. When the archer releases the grip portion 85, the trigger cam 63 is free to pivot to its release position in response to the torque applied by the latch cam lever portion 69, so that the smooth wall 83 is pivoted out of the lever pathway thereby allowing the latch cam 62 to pivot fully to its open position. The second preferred bowstring release 60 also preferably includes spring 87 which extends between and presses on the housing assembly 61 and the trigger cam 63 to bias the trigger cam toward its release position.

The trigger cam 63 of the bowstring release 60 includes means for adjusting the locking position of the trigger cam. The locking adjusting means includes interior surfaces of the trigger cam 63 which form an elongated groove 89 therethrough, and a threaded bore 90, a peg 92 which extends from the housing assembly 61 into the groove 89, and an adjusting screw 93 within the bore 90. The elongated groove 89 has a first end 95 and a second end 96. The threaded bore 90 extends longitudinally with respect to the groove 89 from the first end 95 of the groove 89 to an exterior surface 97 of the trigger cam 63. The adjusting screw 93 within the bore 90 turns to extend a selected distance into the groove 89. The peg 92 extends upwardly into the groove to prevent the trigger cam from pivoting beyond where the peg abuts against the second end 96 of the groove 89 when the trigger cam 63 is in its release position. The peg 92 prevents the trigger cam 63 from pivoting beyond where the peg 92 abuts against the adjusting screw 93 or against the groove first end 95 if the screw 93 is retracted when the trigger cam 63 is in its locking position. By selectively turning the adjusting screw 93, the desired locking position may be selected. The further the adjusting screw 93 extends into the elongated groove 89, the less the grip portion 85 of the trigger cam 63 can be pushed into the housing assembly 61 by the archer's hand.

It is noted that there are various reasons why a passive bowstring release might be inoperable in an active manner. First of all, there might be some obstacle which prevents the lever portion tip 71 from being able to pass directly between the pivotal axis and the smooth wall 83. In the case of the bowstring release 60, the smooth wall 83 itself is such an obstacle because it is offset from the pivotal axis formed by pin 86 in a direction toward the pivotal axis of the latch cam 62 formed by the pin 76. Secondly, the lever portion may be too short to pass directly between the pivotal axis and smooth wall 83, as again is the case with the second preferred release 60. Thirdly, the trigger cam smooth wall may not have any substantial active portion.

In its operation, the bowstring release 60 is intended to be used by an archer as a passive release. Initially, the latch cam 62 is biased to its open position as shown in FIG. 8, with the housing assembly slot 66 and latch cam latching portion notch 72 aligned. By pulling a bowstring 67 back into the slot 66, the archer causes the bowstring 67 to abut and press against the driving wall 73, thereby rotating the latch cam 62 to its latched position. Since the trigger cam 63 is biased to its release position, the latch cam lever portion 69 is able to rotate through its lever pathway without obstruction by the smooth wall 83. The archer then simply presses the trigger cam 63 with his/her hand at the grip portion 85 to rotate the trigger cam 63 to its locking position. The latch cam 62 thereby becomes locked in its latched position as shown in FIG. 7. The retaining wall 74 of the latch cam latching portion 70 retains the bowstring 67 within the slot 66. The archer then is able to easily pull the bowstring 67 with his/her hand on the housing assembly 61 and grip portion 85. Since there are two cams 62 and 63, the archer is not required to resist the strong pull force exerted by the bowstring with the tips of his/her fingers. Instead the strong pull force of the bowstring 67 is resisted by the entire hand holding the adjustable bowstring release 60.

Once the bowstring 67 is pulled back with the adjustable bowstring release 60, the bowstring 67 may be released simply by releasing the grip portion 85 of the trigger cam 63. When the grip portion 85 is released, the trigger cam 63 is able to pivot freely back to its release position as shown in FIG. 8. The trigger cam 63 is caused to pivot back to its release position by both the spring 87 and also the torque exerted on the trigger cam 63 by the latch cam lever portion 69. As this is happening, the latch cam lever portion 69 slides smoothly and continuously along the smooth wall 83 from engagement to disgagement without the jerks or snaps that would be caused by corners, detents, notches, or other impediments. When the latch cam 62 is returned to its open position, the bowstring 67 leaves the slot 66 as shown in FIG. 8.

It is understood that the invention is not confined to the particular construction and arrangement herein illustrated and described, but embraces such modified forms thereof as come within the scope of the following claims.

What is claimed is:

1. A compound leverage bowstring release which may be held in the hand of an archer, comprising:

(a) a housing assembly having an outer contour to be grasped by the hand and a slot for receiving a bowstring;

(b) a latch cam which is pivotally mounted to the housing assembly, the latch cam including a lever portion and a latching portion having a drive wall against which the bowstring pushes when placed in the slot to pivot the latch cam from an open position to a latched position, and a retaining wall which retains the bowstring within the slot when the latch cam is in a latched position, the lever portion pivoting through a lever pathway when the latch cam pivots between the open and latched positions;

(c) a trigger cam which is pivotally mounted to the housing assembly, the trigger cam including a smooth wall which is a smooth continuous curvilinear even surface over which the lever portion always slides smoothly from engagement to disengagement without passing over corners and other impediments, and a grip portion which can be pressed by the archer's hand to pivot the trigger cam from a release position to at least one locking position where the smooth wall intersects the lever pathway of the latch cam lever portion to prevent the latch cam from pivoting from the latched position to the open position, wherein one locking position is a hand-held locking position in which the latch cam lever portion imposes a torque which tends to pivot the trigger cam toward its release position, said torque being counteracted by the archer's hand pressing the grip portion such that when the archer releases his pressure on the grip portion, the trigger cam can pivot so that the latch cam lever portion can pivot the smooth wall out of the lever pathway, thereby allowing the latch cam to pivot fully to the open position.

2. The bowstring release of claim 1 further including a return spring which biases the latch cam to the open position.

3. The bowstring release of claim 1 further including a spring which biases the trigger cam to the release position.

4. The bowstring release of claim 1 wherein the latching portion of the latch cam forms a notch with the drive wall and the retaining wall.

5. The bowstring release of claim 1 wherein the smooth wall is an obstacle which prevents the latch cam lever portion tip from passing directly between a pivotal axis of the trigger cam and the smooth wall, the latch cam lever portion therefore being able to abut and press against only a passive portion of the smooth wall to impose a torque which tends to pivot the trigger cam toward its release position, which torque can be counteracted by the archer's hand pressing the trigger cam grip portion, so that the only trigger cam locking position is the hand-held locking position, the adjustable bowstring release therefore being operable in only a passive manner.

6. The bowstring release of claim 1 wherein the latch cam lever portion is too short to pass directly between a pivotal axis of the trigger cam and the smooth wall, the latch cam lever portion therefore being able to abut and press against only a passive portion of the smooth wall to impose a torque which tends to pivot the trigger cam toward its release position, which torque can be counteracted by the archer's hand pressing the trigger cam grip portion, so that the only trigger cam locking position is the hand-held locking position, the adjustable bowstring release therefore being operable in only a passive manner.

7. The bowstring release of claim 1 further including means for adjusting the locking position of the trigger cam.

8. A compound leverage bowstring release which may be held in the hand of an archer, comprising:

(a) a housing assembly having an outer contour to be grasped by the hand and a slot for receiving a bowstring;

(b) a latch cam which is pivotally mounted to the housing assembly, the latch cam including a lever portion and a latching portion having a drive wall against which the bowstring pushes when placed in the slot to pivot the latch cam from an open position to a latched position, and a retaining wall which retains the bowstring within the slot when the latch cam is in a latched position, the lever portion pivoting through a lever pathway when the latch cam pivots between the open and latched positions;

(c) a trigger cam which is pivotally mounted to the housing assembly, the trigger cam including a smooth wall, and a grip portion which can be pressed by the archer's hand to pivot the trigger cam from a release position to at least one locking position where the smooth wall intersects the lever pathway of the latch cam lever portion to prevent the latch cam from pivoting from the latched position to the open position, wherein one locking position is a hand-held locking position in which the latch cam lever portion imposes a torque which tends to pivot the trigger cam toward its release position, said torque being counteracted by the archer's hand pressing the grip portion such that when the archer releases his pressure on the grip portion, the trigger cam can pivot so that the latch cam lever portion can pivot the smooth wall out of the lever pathway, thereby allowing the latch cam to pivot fully to the open position; and (d) means for adjusting the locking position of the trigger cam comprising interior surfaces of the trigger cam which form an elongated groove therethrough having a first end and a second end, and a threaded bore which extends longitudinally with respect to the groove from an exterior surface of the trigger cam to a first end of the groove; an adjusting screw within the bore which turns to extend a selected distance into the groove; and a peg which extends from the housing assembly into the groove to prevent the trigger cam when in its release position from pivoting beyond where the peg abuts against the second end of the groove, and to prevent the trigger cam when in a locking position from pivoting beyond where the peg abuts against the adjusting screw.

9. The bowstring release of claim 8 wherein the trigger cam further includes a push release portion which when pushed imposes a torque which pivots the trigger cam toward its release position; and wherein the smooth wall is offset from a pivotal axis of the trigger cam away from a pivotal axis of the latch cam and includes an active portion; and wherein the latch cam lever portion is of length such that a tip of the lever portion can pass directly between the smooth wall and the pivotal axis of the trigger cam when the trigger cam is in its release position, so that the latch cam lever portion can abut against the active portion of the smooth wall to impose a torque on the trigger cam which maintains the trigger cam in a locking position so that the trigger cam has an additional locking position which is a lever-held locking position where the locking cam is pivoted from this lever-held locking position in an active manner by pressing the push release portion of the trigger cam.

10. The bowstring release of claim 9 wherein the adjustable screw can be turned to a position where the peg abuts against the screw when the trigger cam is yet in a hand-held locking position to prevent the trigger cam from being pivoted into a lever-held locking position so that the adjustable bowstring release can be adjusted to be operable in only a passive manner.

11. The bowstring release of claim 9 wherein the trigger cam includes two spool portions projecting axially outward which each are pivotably registered in a corresponding cavity in the housing assembly to pivotally mount the trigger cam within the housing assembly, the spool portions extending forwardly of the smooth wall so that the smooth wall faces toward the trigger cam pivotal axis.

12. A passive compound leverage bowstring release which may be held in the hand of an archer, comprising:

(a) a housing assembly having an outer contour to be grasped by the hand and a slot for receiving a bowstring;

(b) a latch cam which is pivotally mounted to the housing assembly, the latch cam including a lever portion and a latching portion having a driving wall against which the bowstring pushes when placed in the slot to pivot the latch cam from an open position to a latched position, and a retaining wall which retains the bowstring within the slot when the latch cam is in a latched position, the lever portion pivoting through a lever pathway when the latch cam pivots between the open and latched positions; and (c) a trigger cam which is pivotally mounted to the housing assembly, the trigger cam including a smooth wall with a passive portion, the smooth wall being a smooth continuous curvilinear even surface over which the lever portion always slides smoothly from engagement to disengagement without passing over corners and other impediments, and a grip portion which can be pressed by the archer's hand to pivot the trigger cam from a release position to a hand-held locking position where the smooth wall passive portion intersects the lever pathway of the latch cam lever portion to prevent the latch cam from pivoting from the latched position to the open position, wherein the latch cam lever portion is able to abut and press against only the passive portion of the smooth wall to thereby impose a torque which tends to pivot the trigger cam toward its release position, which torque can be counteracted by the archer's hand pressing the trigger cam grip portion, so that when the archer releases his pressure on the grip portion, the trigger cam is free to pivot so that the latch cam lever portion can press against and pivot the smooth wall out of the lever pathway, thereby allowing the latch cam to pivot fully to the open position.

13. The bowstring release of claim 12 further including a return spring which biases the latch cam to the open position.

14. The bowstring release of claim 12 further including a spring which biases the trigger cam to the release position.

15. The bowstring release of claim 12 wherein the latching portion of the latch cam forms a notch with the drive wall and the retaining wall.

16. The bowstring release of claim 12 the smooth wall is an obstacle which prevents the latch cam lever portion tip from passing directly between a pivotal axis of the trigger cam and the smooth wall so that the latch cam lever portion is therefore able to abut and press against only a passive portion of the smooth wall.

17. The bowstring release of claim 12 wherein the latch cam lever portion is too short to pass directly between a pivotal axis of the trigger cam and the smooth wall, so that the latch cam lever portion is therefore able to abut and press against only a passive portion of the smooth wall.

18. The bowstring release of claim 12 further including means for adjusting the locking position of the trigger cam.

19. A passive compound leverage bowstring release which may be held in the hand of an archer, comprising:

(a) a housing assembly having an outer contour to be grasped by the hand and a slot for receiving a bowstring;

(b) a latch cam which is pivotally mounted to the housing assembly, the latch cam including a lever portion and a latching portion having a driving wall against which the bowstring pushes when placed in the slot to pivot the latch cam from an open position to a latched position, and a retaining wall which retains the bowstring within the slot when the latch cam is in a latched position, the lever portion pivoting through a lever pathway when the latch cam pivots between the open and latched positions;

(c) a trigger cam which is pivotally mounted to the housing assembly, the trigger cam including a smooth wall with a passive portion, and a grip portion which can be pressed by the archer's hand to pivot the trigger cam from a release position to a hand-held locking position where the smooth wall passive portion intersects the lever pathway of the latch cam lever portion to prevent the latch cam from pivoting from the latched position to the open position, wherein the latch cam lever portion is able to abut and press against only the passive portion of the smooth wall to thereby impose a torque which tends to pivot the trigger cam toward its release position, which torque can be counteracted by the archer's hand pressing the trigger cam grip portion, so that when the archer releases his pressure on the grip portion, the trigger cam is free to pivot so that the latch cam lever portion can press against and pivot the smooth wall out of the lever pathway, thereby allowing the latch cam to pivot fully to the open position; and (d) means for adjusting the locking position of the trigger cam, wherein the locking position adjusting means comprises interior surfaces of the trigger cam which form an elongated groove therethrough having a first end and a second end, and a threaded bore which extends longitudinally with respect to the groove from an exterior surface of the trigger cam to the first end of the groove; an adjusting screw within the bore which turns to extend a selected distance into the groove; and a peg which extends from the housing assembly into the groove to prevent the trigger cam when in its release position from pivoting beyond where the peg abuts against the second end of the groove, and to prevent the trigger cam when in a locking position from pivoting beyond where the peg abuts against the adjusting screw.

20. A passive-active compound leverage bowstring release which may be held in the hand of an archer, comprising:

(a) a housing assembly having an outer contour to be grasped by the hand and a slot for receiving a bowstring;

(b) a latch cam which is pivotally mounted to the housing assembly, the latch cam including a lever portion and a latching portion having a drive wall against which the bowstring pushes when placed in the slot to pivot the latch cam from an open position to a latched position, and a retaining wall which retains the bowstring within the slot when the latch cam is in a latched position, the lever portion pivoting through a lever pathway when the latch cam pivots between the open and latched positions; and (c) a trigger cam which is pivotally mounted to the housing assembly, the trigger cam including a smooth wall which is offset from a pivotal axis of the trigger cam away from a pivotal axis of the latch cam and which has a passive portion and an active portion; a grip portion which can be pressed by the archer's hand to pivot the trigger cam from a release position to a hand-held locking position and a lever-held locking position, the smooth wall intersecting the lever pathway of the latch cam lever portion when the trigger cam is in one of these locking positions to prevent the latch cam from pivoting from the latched position to the open position; and a push release portion which when pressed pivots the trigger cam toward its release position;

wherein when the latch cam is in a latched position and the trigger cam is in the hand-held locking position, the latch cam lever portion imposes a torque which tends to pivot the trigger cam toward its release position, said torque being counteracted by the archer's hand pressing the grip portion, the archer's release of his pressure on the grip portion freeing the trigger cam to pivot so that the latch cam lever portion can press against and pivot the smooth wall out of the lever pathway, thereby allowing the latch cam to pivot fully to the open position; and wherein the trigger cam is mounted within the housing assembly in relation to the latch cam so that a tip of the trigger cam lever portion can pass directly between the smooth wall and the pivotal axis of the trigger cam when the trigger cam is in its release position, so that when the trigger cam is in the lever-held locking position the latch cam lever position can abut against the active portion of the smooth wall to impose a torque which maintains the trigger cam in a locking position so that the trigger cam is pivoted from this lever-held locking position in an active manner by the archer pressing the push release portion of the trigger cam.

21. The passive-active bowstring release of claim 20 wherein the trigger cam includes two spool portions projecting axially outward which each are pivotably registered in a corresponding cavity in the housing assembly to pivotally mount the trigger cam within the housing assembly, the spool portions extending forwardly of the smooth wall so that the smooth wall faces toward the trigger cam pivotal axis.

22. The passive-active bowstring release of claim 20 further including a return spring which biases the latch cam to the open position.

23. The passive-active bowstring release of claim 20 wherein the latching portion of the latch cam forms a notch with the drive wall and the retaining wall.

24. The passive-active bowstring release of claim 20 further including means for adjusting the locking position of the trigger cam.

25. The passive-active bowstring release of claim 24 wherein the locking position adjusting means comprises interior surfaces of the trigger cam which form an elongated groove therethrough having a first end and a second end, and a threaded bore which extends longitudinally with respect to the groove from an exterior surface of the trigger cam to the first end of the groove; an adjusting screw within the bore which turns to extend a selected distance into the groove; and a peg which extends from the housing assembly into the groove to prevent the trigger cam when in its release position from pivoting beyond where the peg abuts against the second end of the groove, and to prevent the trigger cam when in a locking position from pivoting beyond where the peg abuts against the adjusting screw.

26. The passive-active bowstring release of claim 25 wherein the adjusting screw can be turned to an extended position where the peg abuts against the screw when the trigger cam is yet in a hand-held locking position to prevent the trigger cam from being pivoted into a lever-held locking position so that the adjustable bowstring release can be adjusted to be operable in only a passive manner.

* * * * *